US006290225B1

(12) United States Patent
Linder et al.

(10) Patent No.: US 6,290,225 B1
(45) Date of Patent: Sep. 18, 2001

(54) SYSTEMS AND METHODS FOR DYNAMICALLY SETTING STACK HEIGHT AND SHEET ACQUISITION TIME

(75) Inventors: Michael J. Linder, Walworth; William R. Haag, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/447,047

(22) Filed: Nov. 23, 1999

(51) Int. Cl.[7] ..... B65H 1/16

(52) U.S. Cl. ..... 271/155; 271/30.1; 271/147; 271/126; 271/152

(58) Field of Search ..... 271/11, 12, 30, 271/30.1–31, 94, 98, 147–152, 153, 154, 155–157, 126; 414/796.7, 926, 786

(56) References Cited

U.S. PATENT DOCUMENTS 4,470,589 * 9/1984 Singer ..... 271/11
4,575,298 * 3/1986 Maas et al. ..... 271/98
4,610,444 * 9/1986 Land et al. ..... 271/12
5,090,676 * 2/1992 Matsuno et al. ..... 271/12
5,344,133 * 9/1994 Jantsch et al. ..... 271/94
5,556,252 * 9/1996 Kuster ..... 414/796.7
5,645,274 * 7/1997 Ubayashi et al. ..... 271/94
5,893,554 * 4/1999 Okahashi et al. ..... 271/98
5,988,629 * 11/1999 Burlew et al. ..... 271/152
6,123,330 * 9/2000 Schaal ..... 271/31
6,142,463 * 11/2000 Leichnitz et al. ..... 271/159
6,186,492 * 2/2001 Dechau ..... 271/30.1

* cited by examiner

*Primary Examiner*—Christopher P. Ellis
*Assistant Examiner*—Patrick Mackey
(74) *Attorney, Agent, or Firm*—Oliff & Berridge, PLC

(57) ABSTRACT

A sheet feeder feeds sheets separated from a stack to a feed head which is translatable toward take away nip rolls. The sheets are separated from the stack by fluffers and acquired by an acquisition surface of the feed head which is in communication with a vacuum pressure. An air knife is used, in conjunction with a corrugation surface, to separate any secondarily acquired sheets from the acquisition surface. The time for acquiring the sheet is determined from the opening of a vacuum valve in communication with the feed head to the acquiring of the sheet by the acquisition surface. A controller adjusts the position of a supporting tray that supports the stack to maintain the sheet acquisition time as short as possible.

20 Claims, 8 Drawing Sheets

SYSTEMS AND METHODS FOR DYNAMICALLY SETTING STACK HEIGHT AND SHEET ACQUISITION TIME

BACKGROUND OF THE INVENTION

1. Field of Invention

This invention relates generally to a sheet feeder for an image forming engine of an image forming apparatus.

2. Description of Related Art

To supply image recording media, generally referred to as "sheets", to the image forming engine, individual copy sheets are acquired from the top of a stack and are transported forward by a translating vacuum feed head into a set of take away nip rolls. Sheet fluffers separate a sheet from the top of the stack. The translating vacuum feed head acquires the separated sheet and feeds the separated sheet into the set of take-away nip rolls. The time for the translating vacuum feed head to acquire the sheet is relatively short. The height of the stack must be monitored and adjusted during sheet feeding to maintain the sheet acquisition time as short as possible. The stack height must also be monitored and adjusted to correct for problems caused, for example, by edge welding and/or poor separation between sheets. Current stack height monitoring methods rely on contact with the stack. This may cause marking of the sheets or reduction in the fluffing of the stack. Optical sensors are also currently used to monitor stack height. The optical sensors, however, may not be reliable when looking at the edge or top of a fluffed stack.

SUMMARY OF THE INVENTION

In accordance with various exemplary embodiments of the systems and methods according to this invention, a sheet feed apparatus for an image forming apparatus includes sheet fluffers to separate a top sheet from the stack, a vacuum source that is selectively actuable, a translating vacuum feed head attached to the vacuum source to acquire the top sheet of the stack, a unidirectional rotating drive mechanism, and a control circuit. The unidirectional rotating drive mechanism causes the translating vacuum feed head to reciprocate from a first position to a second position. The control circuit dynamically adjusts the stack height to maintain the lowest possible sheet acquisition time. The sheet acquisition time is the time interval between the opening of a vacuum manifold valve and the acquisition of the sheet by the translating vacuum feed head. In various exemplary embodiments, the control circuit controls the stack height based on the measured sheet acquisition time for a predetermined number of previously successfully fed sheets and the average stack height for the predetermined number of previously successfully fed sheets.

Other features of the invention will become apparent as the following description proceeds and upon reference to the drawings.

DESCRIPTION OF THE PREFERRED EMBODIMENTS

Figure 1:
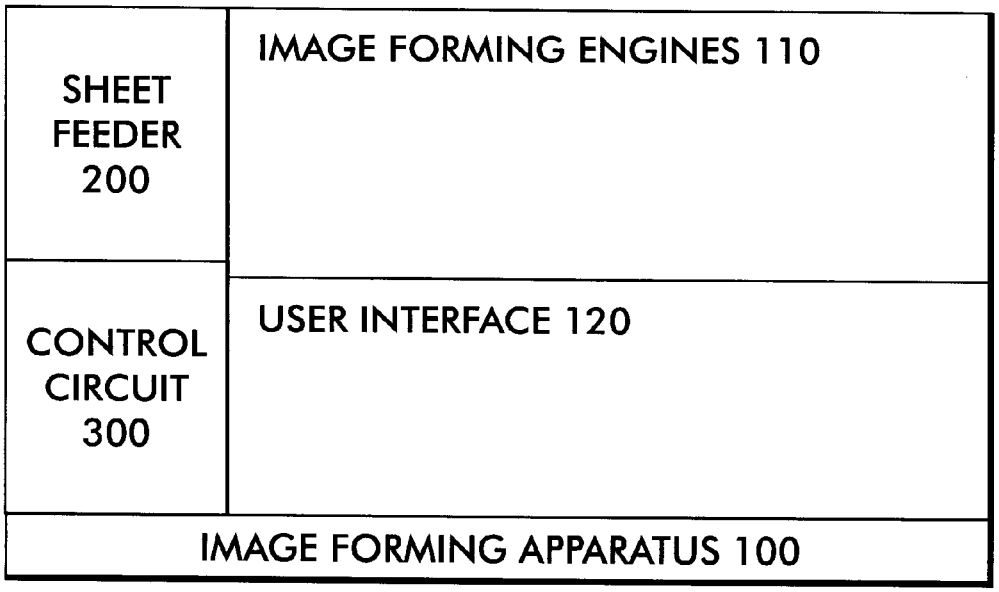
FIG. 1 is a block diagram of one exemplary embodiment of an image forming apparatus according to the invention.

FIG. 1 is a block diagram of one exemplary embodiment of an image forming apparatus 100 according to the invention. The image forming apparatus 100 has an image forming engine 110 for fixing an image to a sheet of recording media. A user interface 120 allows a user of the image forming apparatus 100 to input a print request, including a total number of sheets to be printed. A sheet feeder 200 separates a sheet from the top of a stack, acquires the separated sheet and delivers the separated sheet to the image forming engine 110. A control circuit 300 controls the stack height based on the sheet acquisition times for one or more previously successfully fed sheets and on the average stack height for one or more previously successfully fed sheets. The control circuit 300 also controls the take-away nip rolls that receive the acquired sheet and deliver the sheet to the image forming engine 110.

Figure 2:
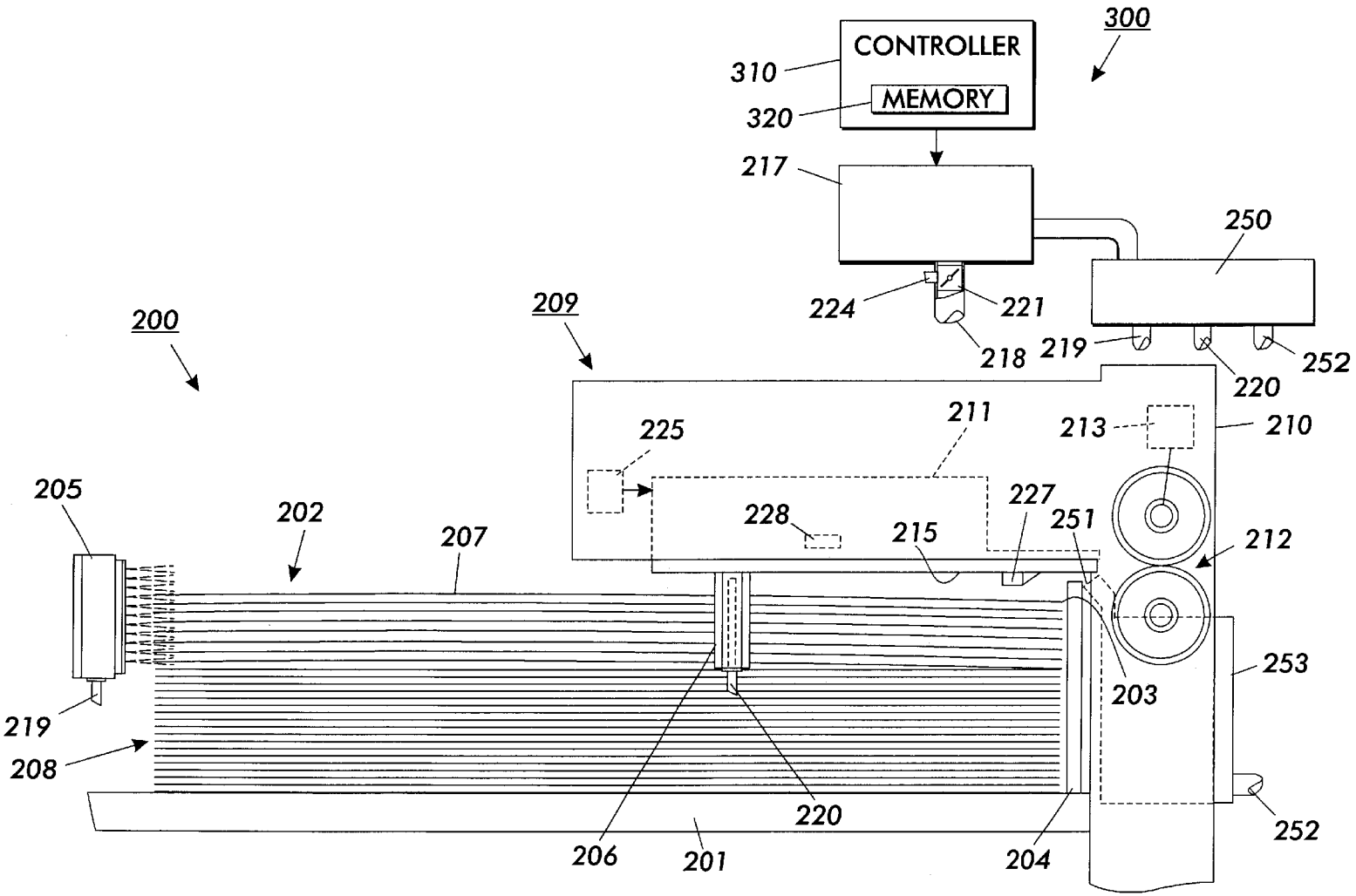
FIG. 2 is a side view schematically illustrating one exemplary embodiment of a sheet feeder incorporating the systems and methods according to the invention.

FIG. 2 is a side elevation schematic view of one exemplary embodiment of the sheet feeder 200 and control circuit 300 according to the invention. The sheet feeder 200 includes a support tray 201 that is tiltable and adjustable to accommodate sheets having various sizes and characteristics. A stack 202 of sheets is supported on the sheet support tray 201 so that the leading edge 203 of the stack 202 abuts a registration wall 204. Sheet fluffers 205 and 206 blow air against the stack 202 to separate the top sheet 207 from the stack 202. The trailing edge sheet fluffer 205 blows air at a trailing edge 208 of the stack 202. Two side edge sheet fluffers 206, only one of which can be seen in FIG. 2, blow air at opposing sides of the stack 202.

A feed head assembly 209 includes a housing 210 and supports a translating vacuum feed head 211 so that the translating vacuum feed head 211 can move toward and away from the pair of take-away nip rolls 212. The take-away nip rolls 212 are driven by a stepper motor 213. A lead edge attitude sensor 227 on the translating vacuum feed head 211 both senses the stack height and detects when the top sheet 207 is acquired by an acquisition surface 215 of the translating vacuum feed head 211. The stack height is defined as the distance from the top of the stack 202 to the acquisition surface 215. Vacuum pressure is applied to the translating vacuum feed head 211 by a blower assembly 217 through a vacuum manifold 218. In one exemplary embodiment, the blower assembly 217 includes a variable speed brushless DC motor. The housing 210 of the feed head assembly 209 also supports a unidirectional rotating drive mechanism 225 that moves the translating vacuum feed head 211.

Air is supplied from the blower assembly 217 to a positive pressure plenum 250. Air is supplied from the positive pressure plenum 250 to the sheet fluffers 205 and 206 through at least two fluffer manifolds 219 and 220, respectively. Air is also supplied from the positive pressure plenum 250 to an air knife 251. The air is supplied from the positive pressure plenum 250 to an air knife plenum 253 through an air knife manifold 252. The air knife 251 separates any secondarily acquired sheets from the top sheet 207 after the top sheet 207 is acquired by the acquisition surface 215. The secondarily acquired sheets are those sheets that stuck to the top sheet 207 as it was acquired by the acquisition surface 215.

The vacuum manifold 218 is opened and closed by a vacuum manifold valve 221. Opening the vacuum manifold valve 221 allows vacuum pressure to be applied to the translating vacuum feed head 211 by the blower assembly 217. In one exemplary embodiment, the vacuum manifold valve 221 is opened by a stepper motor. A vacuum manifold valve sensor 224 detects the opening of the vacuum manifold valve 221. A signal is sent to the control circuit 300 when the vacuum manifold valve sensor 224 detects that the vacuum manifold valve 221 has been opened.

The control circuit 300 includes a controller 310 and a memory 320. In one exemplary embodiment, the controller 310 receives a vacuum signal from the vacuum manifold valve sensor 224 and an acquisition signal from the lead edge attitude sensor 227 and controls the position of the support tray 201 in response to the vacuum and acquisition signals. The controller 310 also controls the stepper motor 213 that drives the take away nip rolls 212 by executing a control program stored in the memory 320.

Figure 3:
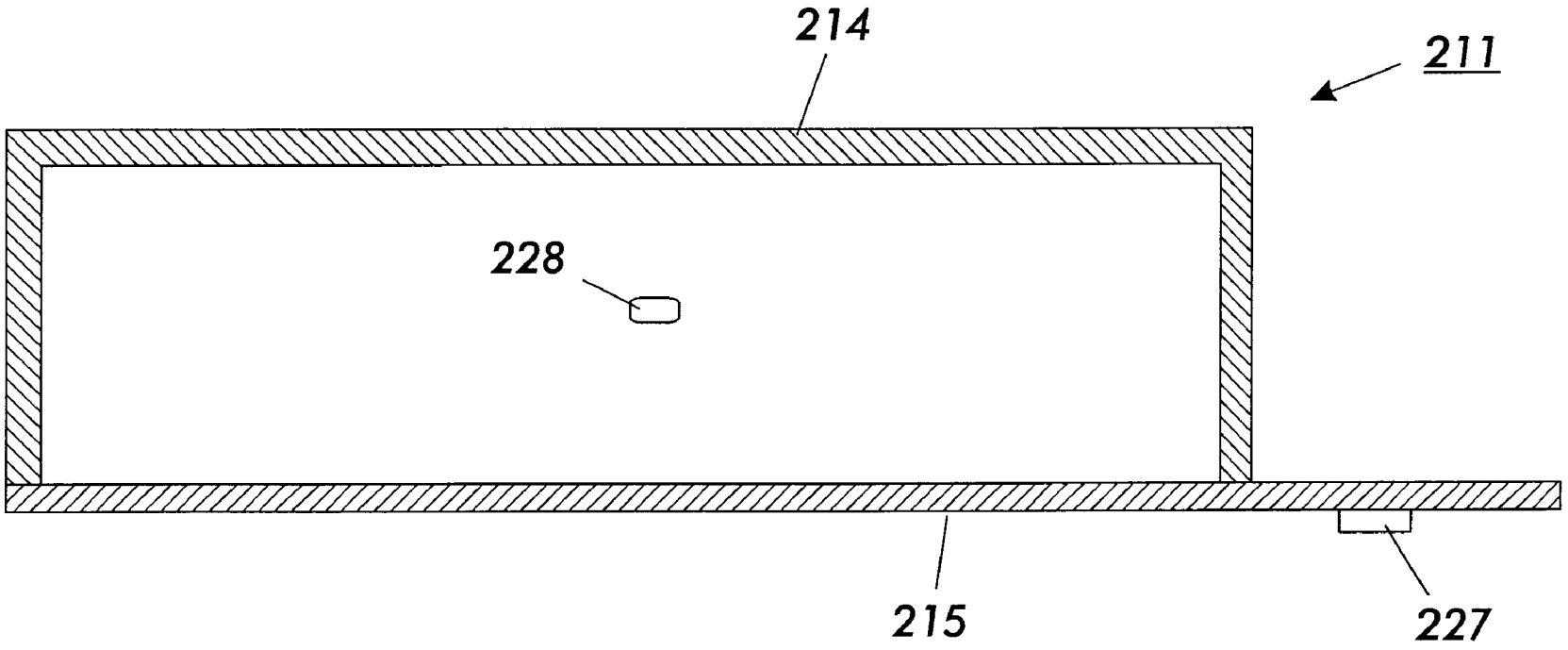
FIG. 3 is a side sectional view of the feed head.

FIG. 3 is a schematic side elevation sectional view of the translating vacuum feed head 211. The translating vacuum feed head 211 includes a plenum 214 and the acquisition surface 215. In one exemplary embodiment, the plenum 214 is formed of an injection molded plastic. The plenum 214 includes a port 228 formed in one side which is connected to the vacuum manifold 218. The junction of the port 228 and the vacuum manifold 218 includes a sliding seal (not shown) that allows the translating vacuum feed head 211 to move toward and away from the take-away nip rolls 212 while maintaining the connection to the vacuum manifold 218. The lead edge attitude sensor 227 is mounted at a forward side of the plenum 214. Sheet acquisition is detected by the lead edge attitude sensor 227.

The lead edge attitude sensor 227 may include a position sensitive device or multiple optical sensors with different focal lengths. In one exemplary embodiment, the lead edge attitude sensor 227 is an infrared LED with 4 detectors which determine the location of the lead edge of the top sheet 207 within a range of 0 mm–3 mm, 3 mm–6 mm, 6 mm–9 mm or greater than 9 mm from the acquisition surface 215. The lead edge attitude sensor 227 sends a signal to the controller 310. At various times this signal is a stack height signal that indicates the distance between the top of the fluffed stack and the lead edge attitude sensor 227 and an acquisition signal that indicates the top sheet 207 of the stack 202 has been acquired. When this signal indicates that the lead edge of the top sheet 207 is in the 0–3 mm range, the controller 310 determines that the top sheet 207 has been acquired by the translating vacuum feed head 211.

Figure 4:
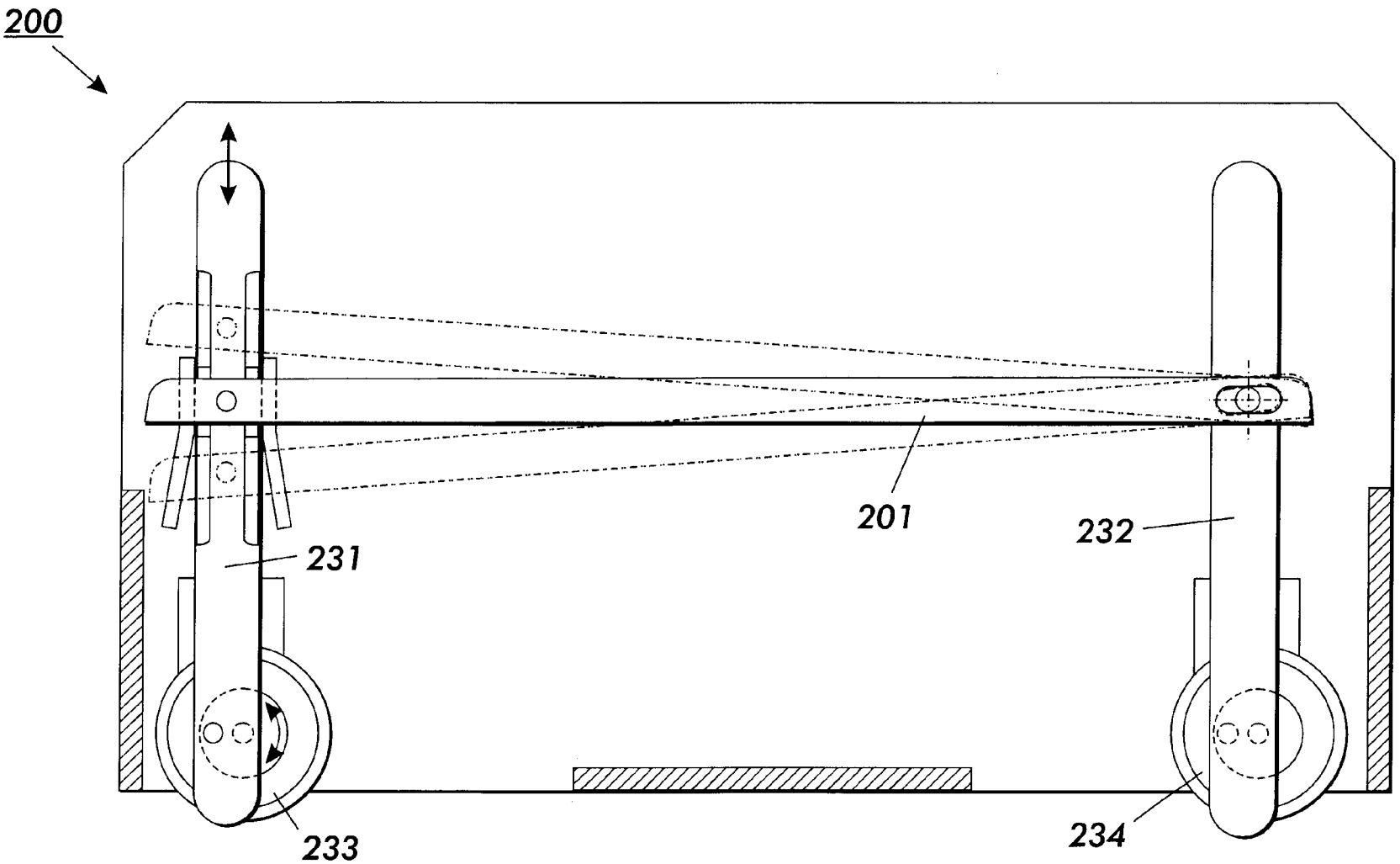
FIG. 4 is a schematic side view of the support tray and elevators of the sheet feeder.

To feed sheets from the sheet feeder 200 to the image forming engine 110, the stack 202 is placed on the support tray 201. As shown in FIG. 4, the support tray 201 is supported at both ends by elevators 231 and 232. Each elevator 231 and 232 is driven by an independent motor 233 and 234, respectively. In various exemplary embodiments of the invention, the motors 233 and 234 can be stepper motors or brushless DC motors. The support tray 201 can be raised or lowered and/or tilted by driving one or both of the independent motors 233 and 234. The support tray 201 can be tilted to compensate for any curl that may be in the stack 202. After the stack 202 is loaded, the controller 310 drives the independent motors 233 and 234 to raise the support tray 201 to an initial stack height.

Once the stack 202 is set to the initial stack height and a print request is input to the user interface 120, the blower assembly 217 is activated. The trail edge sheet fluffer 205, the side edge sheet fluffers 206, and the air knife 251 are supplied with air from the blower assembly 217. The translating vacuum feed head 211 is supplied with a vacuum pressure by the blower assembly 217. The trail edge sheet fluffer 205 and the side edge sheet fluffers 206 separate sheets from the top of the stack 202. The top sheet 207 is acquired by the acquisition surface 215 of the translating vacuum feed head 211. The air knife 251 separates any secondarily acquired sheets from the top sheet 207 so that only the top sheet 207 is feed to the take-away nip rolls 212.

The unidirectional rotating drive mechanism 225 drives the translating vacuum feed head 211 forward with a velocity profile which delivers the acquired sheet to the take-away nip rolls 212 at a speed of, for example, approximately 430 mm/s. The top sheet 207 is delivered to take-away nip rolls 212. The take-away nip rolls 212 are driven by the stepper motor 213, which is controlled by the controller 310. Once the top sheet 207 is delivered to the take-away nip rolls 212, the controller 310 increases the speed of the stepper motor 213 to accelerate the top sheet 207 to match the transport speed of the image forming engine 110.

The sheet acquisition time is defined as the time between the opening of the vacuum manifold valve 221 as detected by the vacuum manifold valve sensor 224 and acquisition of the top sheet 207 by the acquisition surface 215 of the translating vacuum feed head 211 as detected by the lead edge attitude sensor 227. It should be appreciated that the sheet acquisition time can be determined by various other methods. Performance of the sheet feeder 200 may be improved by dynamically adjusting the stack height during feeding by adjusting the position of the support tray 201.

Figure 5A:
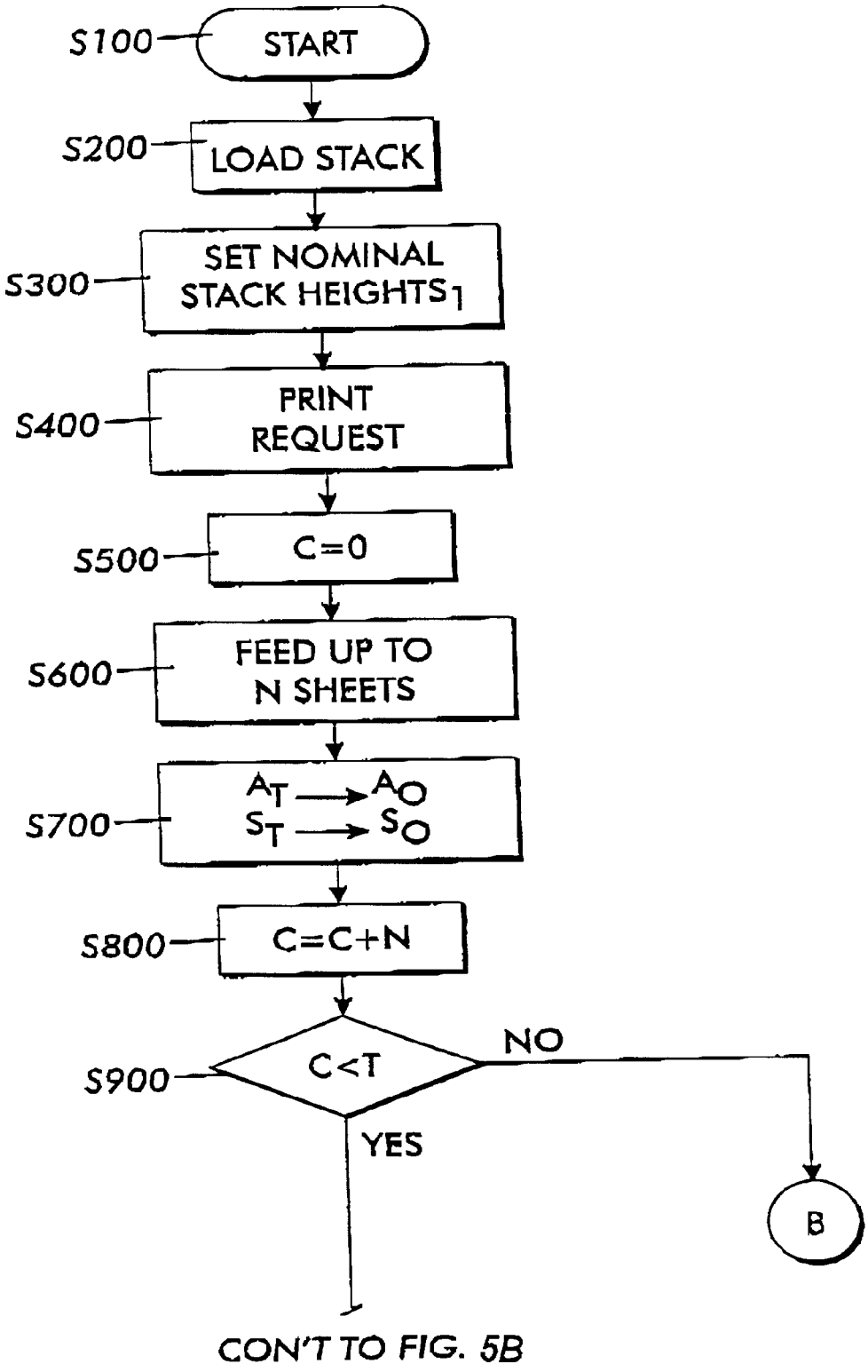
FIGS. 5A and 5B are a flow chart of a stack height and sheet acquisition time adjusting control method according to the invention.
Figure 5B:
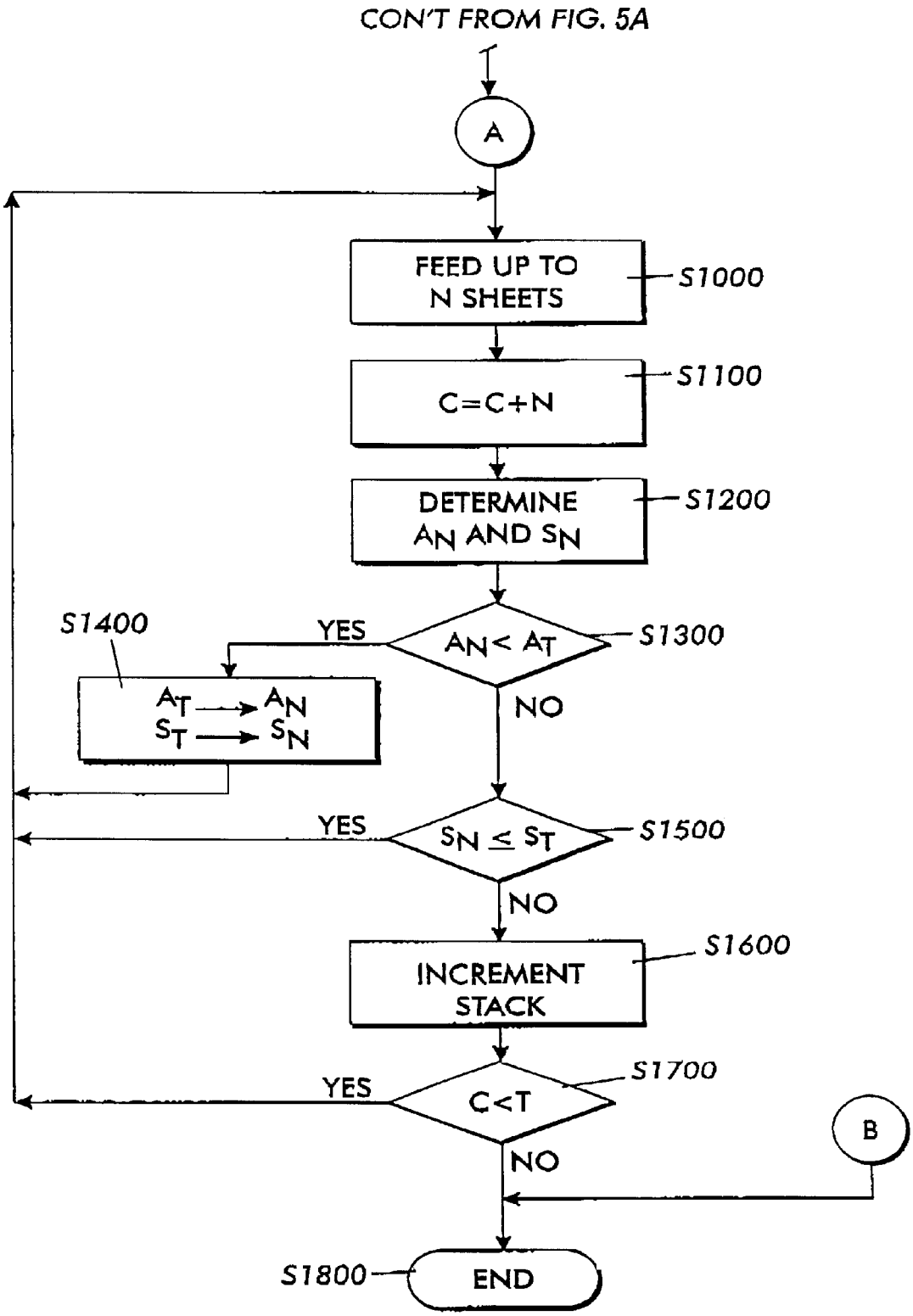

FIGS. 5A and 5B are a flowchart outlining one exemplary embodiment of a stack height and sheet acquisition time adjusting method according to the invention. Beginning in step S100, control continues to step S200, where a user loads a stack of sheets onto the support tray. Next in step S300, the stack is raised to a nominal height $S_I$. In one exemplary embodiment, the nominal stack height $S_I$, is 12 mm. Then, in step S400, the user enters a print request. The print request includes a total number T of sheets to be printed. It should be appreciated that steps S200 and S300 are used only when the sheets are first placed in the support tray. Thereafter, steps S200 and S300 can be skipped until the next time sheets are added to the support tray. Control then continues to step S500.

In step S500, a counter is set to an initial value C=0. Then, in step S600, the sheet feeder of the image forming apparatus feeds up to a number N of sheets to the image forming engine. Next, in step S700, a value $A_O$ from the individual sheet acquisition times for the number N of fed sheets is determined and a threshold value $A_T$ is set equal to the value $A_O$. It should be appreciated that value $A_O$ can be a sum of the individual acquisition times, an average acquisition time, or any other value that sufficiently represents the actual acquisition time to allow the acquisition time to be controlled. A value $S_O$ of the stack height for the number N of fed sheets is also determined and a threshold value $S_T$ is set equal to the value $S_O$. It should be appreciated that the value $S_O$ can be a sum of the individual stack heights, an average stack height, or any other value that sufficiently represents the actual stack height to allow the stack height to be controlled. Control then continues to step S800.

In step S800, the counter C is incremented by the number N of fed sheets. Next, in step S900, the incremented value is compared to the total number T of sheets requested. If the incremented value is equal to, or more than, the total number T of sheets requested, control jumps to step S1800. Otherwise, if the incremented value is less than the total number T of sheets requested, control continues to step S1000.

In step S1000, the sheet feeder feeds up to an additional number N sheets to the image forming engine. Then, in step S1100, the counter C is incremented by the additional N fed sheets. Next, in step S1200, a value $A_N$ of the sheet acquisition times for the additional N fed sheets is determined and a value $S_N$ for the additional N fed sheets is determined. Then, in step S1300, the value $A_N$ of the acquisition times for the additional N fed sheets is compared to the threshold value $A_T$. If the value $A_N$ is less than the threshold value $A_T$, the control continues to step S1400. If the value $A_N$ is greater than the threshold value $A_T$, the control jumps to step 1500.

In step S1400, the threshold value $A_T$ is set equal to the value $A_N$ and the threshold value $S_T$ is set equal to the value $S_N$ for the last number of fed sheets. Control then returns to step S1000.

In contrast, in step S1500, the value $S_N$ is compared to the threshold value $S_T$. If the value $S_N$ is lower than or equal to the threshold value $S_T$, control again returns to step S1000. If the value $S_N$ is greater than the threshold value $S_T$, control continues to step S1600. In step S1600, the stack height is adjusted by moving the stack closer to the feed head. Control then continues to step S1700.

In step S1700, the incremented value is compared to the total number T of sheets requested. If the incremented value is equal to, or more than, the total number T of sheets requested, control again jumps to step S1800. Otherwise, if the incremented value is less than the total number T of sheets requested, control returns to step S1000.

In step S1800, once the number of sheets actually fed equals or exceeds the predetermined number T specified in the print request command, control ends.

Figure 6A:
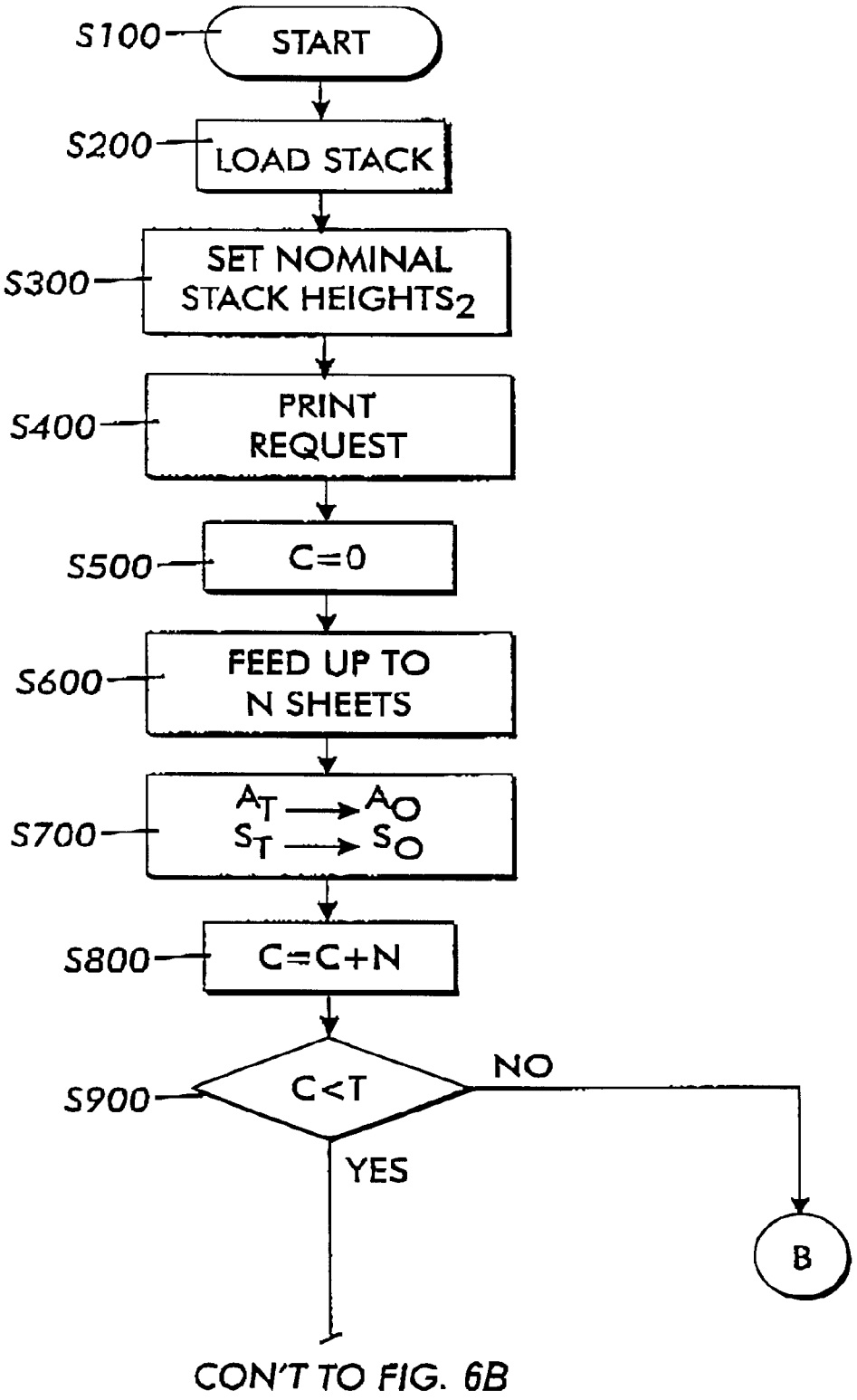
FIGS. 6A and 6B are a flow chart of a stack height and sheet acquisition time adjusting control method according to another exemplary embodiment of the invention.
Figure 6B:
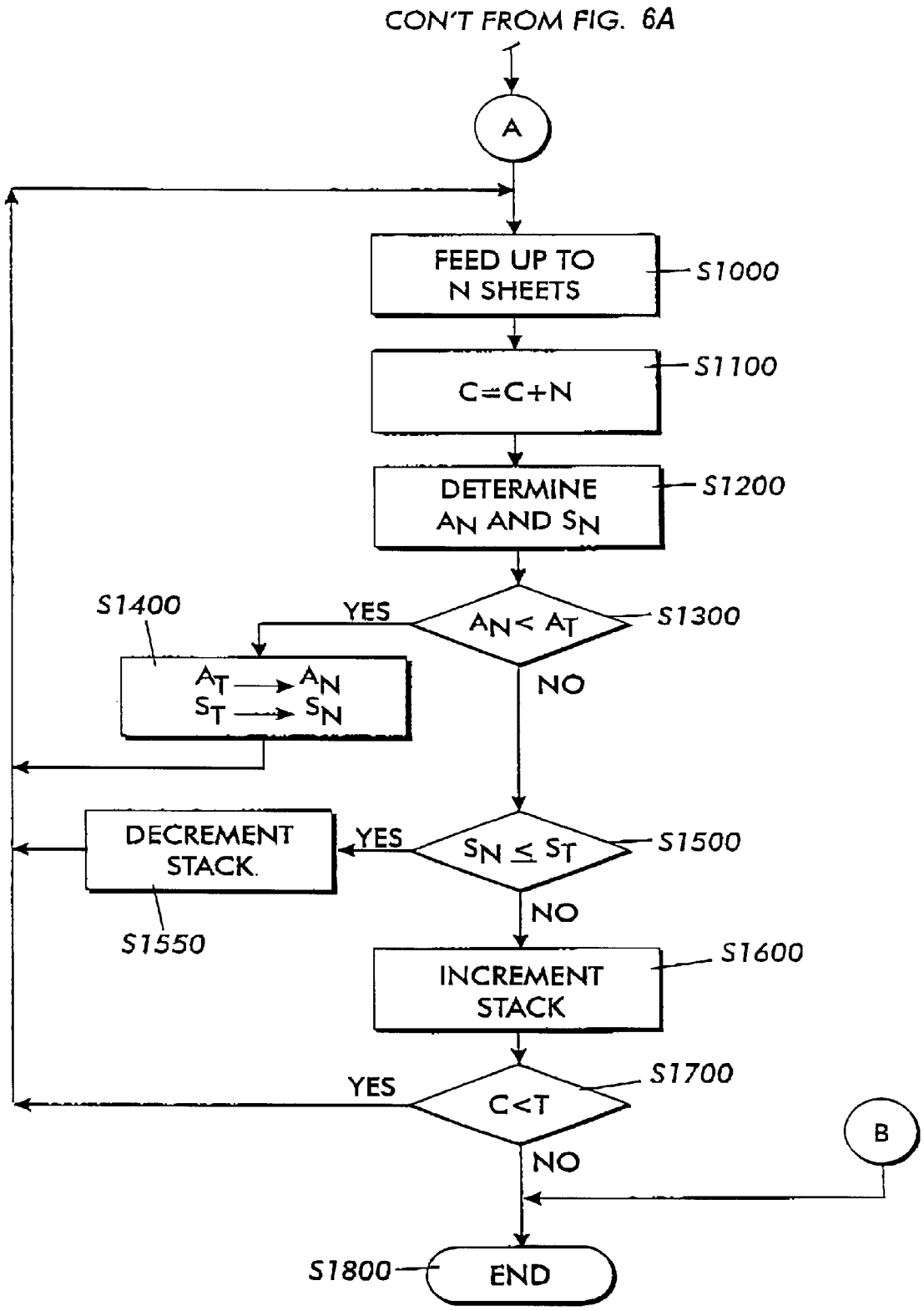

FIGS. 6A and 6B are a flowchart outlining another exemplary embodiment of a stack height and sheet acquisition time adjusting method according to the invention. Steps S100 through S1400 and S1600 through S1800 are the same as in FIGS. 5A and 5B. In step S1500, if the value $S_N$ is less than the threshold value $S_T$, control continues to step S1550. Otherwise, control jumps to step S1600. In step S1550, the stack height is adjusted by moving the stack away from the feed head. Control then returns to step S1000.

It should be understood that the control circuit 300 shown in FIGS. 1 and 2 can be implemented as portions of a suitably programmed general purpose computer. Alternatively, the control circuit can be implemented as physically distinct hardware circuits within an ASIC, or using a FPGA, a PDL, a PLA or a PAL, or using discrete logic elements or discrete circuit elements. The particular form the control circuit shown in FIGS. 1 and 2 will take is a design choice and will be obvious and predictable to those skilled in the art.

The stack height and sheet acquisition time adjusting control systems and methods of this invention can be implemented on a programmed general purpose computer. However, the sheet acquisition time control systems and methods of this invention can also be implemented on a special purpose computer, a programmed microprocessor or microcontroller and peripheral integrated circuit elements, an ASIC or other integrated circuit, a digital signal processor, a hardwired electronic or log circuit such as a discrete element circuit, a programmable logic device such as a PLD, PLA, FPGA or PAL, or the like. In general, any device capable of implementing a finite state machine that is in turn capable of implementing the flow diagram of FIGS. 5A and 5B, can be used to implement the sheet acquisition time control systems and methods of this invention.

As shown in FIG. 2, the memory 320 may be implemented using an alterable volatile and/or non-volatile memory and/or non-alterable memory. However, the memory 320 can also be implemented using a PROM, an EPROM, an optical ROM disk, such as a CD-ROM or DVD-ROM, and disk drive or the like.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A sheet feeder, comprising:

a sheet separator that separate sheets from a stack of sheets;

a feed head that acquires a sheet separated from the stack;

a controller that dynamically adjusts a position of the stack based on an acquisition time value and a stack height value.

2. The sheet feeder according to claim 1, wherein the controller determines the acquisition time value for a number of acquired sheets and determines the stack height value for the number of acquired sheets.

3. The sheet feeder according to claim 2, wherein the controller compares at least one of the acquisition time value to a threshold acquisition time value and the stack height value to a threshold stack height value.

4. The sheet feeder according to claim 3, wherein the controller moves the stack closer to the feed head if at least one of the acquisition time value is greater than the threshold acquisition time value or the stack height value is greater than the threshold stack height value.

5. The sheet feed according to claim 3, wherein the controller moves the stack away from the feed head if the stack height value is less than the threshold stack height value.

6. The sheet feeder according to claim 3, wherein the controller resets the threshold acquisition time value equal to the acquisition time value and resets the threshold stack height value equal to the stack height value if the acquisition time value is less than the threshold acquisition time value.

7. The sheet feeder according to claim 1, further comprising a tray supporting the stack at a position spaced from the feed head.

8. The sheet feeder according to claim 7, wherein the controller controls a position of the tray to maintain the acquisition time value for a number of acquired sheets equal to or below a threshold acquisition time value for the number of acquired sheets.

9. A method of feeding sheets from a stack of sheets, comprising:

separating a sheet from the top of the stack;

acquiring the sheet;

dynamically determining an acquisition time value for a number of acquired sheets;

determining a stack height value for the number of acquired sheets; and adjusting a position of the stack based on the determined acquisition time value and the determined stack height value.

10. The method according to claim 9, further comprising at least one of:

comparing the determined acquisition time value to a threshold acquisition time value; and comparing the determined stack height value to a threshold stack height value.

11. The method according to claim 10, further comprising:

raising the stack when at least one of the determined acquisition time value is greater than the threshold acquisition time value or the determined stack height value is greater than the threshold stack height value.

12. The method according to claim 10, further comprising:

lowering the stack when the determined stack height value is less than the threshold stack height value.

13. The method according to claim 10, further comprising:

supporting the stack on a tray; and adjusting a position of the tray so that the determined acquisition time value is equal to or below the threshold acquisition time value.

14. The method according to claim 10, further comprising, if the acquisition time value is less than the threshold acquisition time value:

resetting the threshold acquisition time value equal to the acquisition time value; and resetting the threshold stack height value equal to the stack height value.

15. A sheet feeder, comprising:

means for separating a sheet from the top of a stack;

means for acquiring the sheet;

means for dynamically determining an acquisition time value for a number of acquired sheets;

means for determining a stack height value for the number of acquired sheets;

means for adjusting a position of the stack based on the determined acquisition time value and the determined stack height value.

16. The sheet feeder according to claim 15, further comprising at least one of:

means for comparing the determined acquisition time value to a threshold acquisition time value; and means for comparing the determined stack height value to a threshold stack height value.

17. The sheet feeder according to claim 16, further comprising:

means for raising the stack when at least one of the determined acquisition time value is greater than the threshold acquisition time value or the determined stack height value is greater than the threshold stack height value.

18. The sheet feeder according to claim 16, further comprising:

means for lowering the stack when the determined stack height value is less than the threshold stack height value.

19. The sheet feeder according to claim 16, further comprising:

means for supporting the stack; and means for adjusting a position of the supporting means so that the determined acquisition time value is equal to or below the threshold acquisition time value.

20. The sheet feeder according to claim 16, further comprising:

means for resetting the threshold acquisition time value equal to the acquisition time value and the threshold stack height value equal to the stack height value if the acquisition time value is less than the threshold acquisition time value.

* * * * *